United States Patent [19]

Watanabe et al.

[11] Patent Number: 4,944,616

[45] Date of Patent: Jul. 31, 1990

[54] PASSBOOK READ/WRITE MECHANISM

[75] Inventors: Shingo Watanabe, Chigasaki; Shohei Murakami, Hadano, both of Japan

[73] Assignee: NCR Corporation, Dayton, Ohio

[21] Appl. No.: 432,120

[22] Filed: Nov. 6, 1989

[51] Int. Cl.[5] ..... B41J 5/00

[52] U.S. Cl. ..... 400/105; 400/708; 360/2; 360/101; 360/106; 235/279; 235/432

[58] Field of Search ..... 400/105, 56, 77, 708; 235/379, 432, 433, 419; 346/134; 360/1-2, 6, 55, 57, 75, 101, 106, 126, 121; 364/705.02

[56] References Cited

U.S. PATENT DOCUMENTS

| | | | |
|---|---|---|---|
| 3,508,032 | 4/1970 | MacDuffee et al. | 400/105 |
| 3,788,441 | 1/1974 | Vartanian, Jr. et al. | 400/105 |
| 3,819,024 | 6/1974 | Markauis | 400/105 |
| 3,823,405 | 7/1974 | Andreaggi et al. | 400/105 |
| 3,978,964 | 9/1976 | Kwan . | |
| 4,023,203 | 5/1977 | Baba et al. . | |
| 4,039,069 | 8/1977 | Kwan et al. . | |
| 4,166,945 | 9/1979 | Imoyama et al. . | |
| 4,494,127 | 1/1985 | King . | |
| 4,675,764 | 6/1987 | Stock . | |
| 4,743,129 | 5/1988 | Keryhuel et al. | 400/708 |
| 4,758,713 | 7/1988 | Matsukawa . | |
| 4,793,605 | 12/1988 | Tajima | 400/708 |

*Primary Examiner*—Eugene H. Eickholt

*Attorney, Agent, or Firm*—Wilbert Hawk, Jr.; Albert L. Sessler, Jr.; George J. Muckenthaler

[57] ABSTRACT

A magnetic read/write head is supported on the carriage that carries the platen of a passbook printer. The passbook is moved to the printing station and a sensor is provided for detecting the presence of the passbook. A height adjusting member operates to move the read/write head into position for writing data into and for reading data from a magnetic stripe on the passbook.

16 Claims, 4 Drawing Sheets

PASSBOOK READ/WRITE MECHANISM

CROSS REFERENCE TO RELATED APPLICATIONS

Passbook Transport Mechanism, copending application Ser. No. 432,435, filed Nov. 6, 1989 invented by Yasushi Nakamura and Junnosuke Takeda and assigned to NCR Corporation.

Passbook Page Turning Mechanism, copending application Ser. No. 432,754, filed Nov. 6, 1989 invented by Ken Ebato and Susuma Sato and assigned to NCR Corporation.

BACKGROUND OF THE INVENTION

In the field of financial-type business transactions, a commonly used record medium is a passbook or bankbook for maintaining a record of each transaction. The passbook is inserted into a business machine for reading the contents of the passbook, for printing information or data in the passbook, and for recording the printed information or data in the passbook.

In the operation of the business machine for passbook printing therein, the passbook is inserted at the front of the machine and the passbook is then transported or conveyed past a printing station toward the rear of the machine where the current status of the record is read by means of read/write mechanism from a magnetic stripe on the passbook. The passbook is then transported to the printing station for printing operation after which the passbook is again transported toward the rear of the machine where the printed information is recorded by means of the read/write mechanism in a write operation on the magnetic stripe. The passbook is then transported toward the front and out of the business machine.

The passbook includes a magnetic stripe on the back cover thereof and a read/write head is included in the business machine for operating with the magnetic stripe in the reading and writing of information or data regarding the business transaction.

Representative documentation in the field of read/-write mechanisms includes U.S. Pat. No. 3,978,964, issued to O. Kwan on Sept. 7, 1976, which discloses a magnetic head control assembly for a magnetic passbook printing system.

U.S. Pat. No. 4,023,203, issued to M. Baba et al. on May 10, 1977, discloses a system for compensating a phase difference between magnetic tracks in a magnetic recorded information regenerating apparatus.

U.S. Pat. No. 4,039,069, issued to O. Kwan et al. on Aug. 2, 1977, discloses a magnetic stripe passbook and scanner for document printing apparatus.

U.S. Pat. No. 4,166,945, issued to T. Inoyama et al. on Sept. 4, 1979, discloses versatile automatic transaction equipment.

U.S. Pat. No. 4,494,127, issued to O. B. King on Jan. 15, 1985, discloses apparatus and method for recording both machine-readable and printed information.

U.S. Pat. No. 4,675,764, issued to H. Stock on June 23, 1987, discloses a drive mechanism for a magnetic head carriage assembly.

And, U.S. Pat. No. 4,758,713, issued to M. Matsukawa on July 19, 1988, discloses banking terminal equipment having a passbook printer with a magnetic stripe reader.

SUMMARY OF THE INVENTION

The present invention relates to a business machine for use in financial transactions and more particularly to a passbook read/write mechanism. The passbook includes a magnetic stripe on the back cover thereof which incorporates data or information concerning the customer's account. A read head on the business machine reads data from the magnetic stripe and a write head writes data into and records such data in the magnetic stripe.

In accordance with the above discussion, there is provided a passbook read/write mechanism in a business machine of the printer type which includes a print head, a platen and a carriage, the read/write mechanism having a magnetic head capable of reading data from and writing data into a magnetic stripe on the passbook, the carriage being movable in a direction perpendicular to the direction in which the passbook is conveyed into and through the printer along a passbook feed path and opposite to the direction of movement of the print head, the magnetic head being adjustably movable relative to the print head, and driving means for driving the carriage with the magnetic head and the platen in the perpendicular direction and wherein said print head is moved in synchronism with said carriage for printing data on the passbook and said magnetic head is moved with said carriage for reading data from and writing data into the magnetic stripe on the passbook.

In view of the above discussion, a principal object of the present invention is to provide a read/write mechanism for a passbook printer.

Another object of the present invention is to provide a read/write mechanism for reading a magnetic stripe on a passbook.

An additional object of the present invention is to provide a carriage for carrying a print head and a carriage for carrying a magnetic head in transverse manner on a printer.

A further object of the present invention is to provide a passbook printer having a carriage for carrying a print head, and a carriage for carrying a platen and a magnetic head across a printer thereby enabling printing of data on the passbook and reading data from and writing data into a magnetic stripe on the passbook.

Additional advantages and features of the present invention will become apparent and fully understood from a reading of the following description taken together with the annexed drawing.

DESCRIPTION OF THE PREFERRED EMBODIMENT

Figure 1:
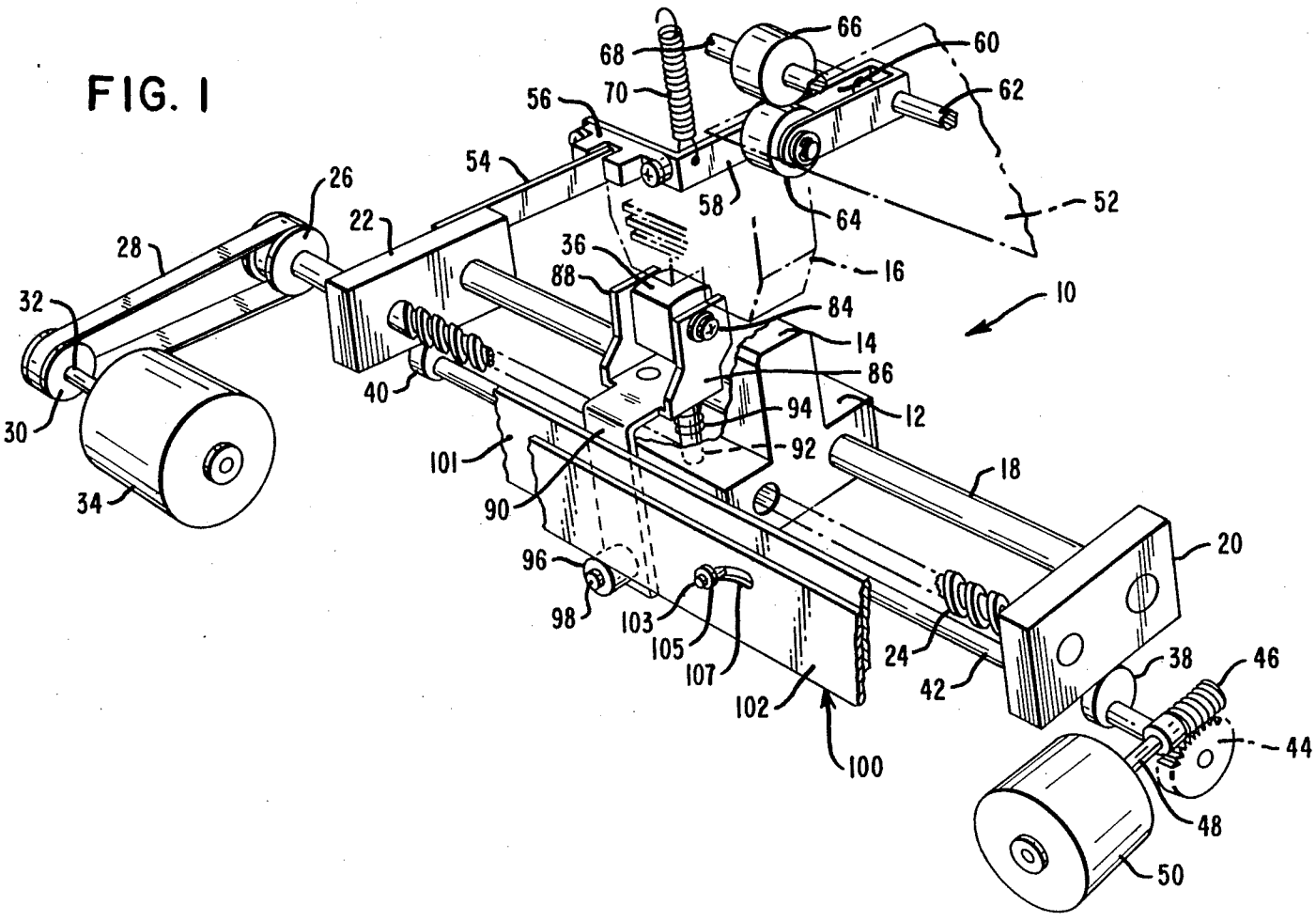
FIG. 1 is a perspective view of read/write mechanism incorporating the subject matter of the present invention.

Referring now to the drawing, FIG. 1 is a perspective view showing an arrangement for a printer 10 that includes a carriage 12, a platen 14, and an opposed print head assembly 16. The print head assembly 16 is driven by suitable drive means (not shown) in transverse manner on the printer 10. The carriage 12 is slidably carried on a guide rod 18 which is coupled to side brackets or plates 20 and 22. The carriage 12 is driven by a lead screw 24 which is also coupled (in the manner of being journaled in) the side brackets 20 and 22. The side brackets 20 and 22 are supported in a manner to be swingable about the lead screw 24. The lead screw 24 has a pulley 26 secured to the left end thereof and a belt 28 is trained around the pulley 26 and around a pulley 30 secured to the end of a shaft 32 of a motor 34. A read/write magnetic head 36 is supported by the carriage 12 and is positioned adjacent the platen 14.

The right and left brackets 20 and 22 are supported on respective cams 38 and 40 which are provided on a shaft 42 suitably journaled on the printer 10. The carriage 12 which carries the platen 14 and the magnetic head 36 is supported by means of the right and left brackets 20 and 22 engaging the cams 38 and 40 of the shaft 42. The shaft 42 has a gear 44 secured to the right end thereof which gear meshes with a gear 46 on the end of a shaft 48 of a stepping motor 50. The carriage 12 is caused to be raised and lowered by rotational driving of the shaft 42 and the cams 38 and 40 by the motor 50 wherein the gap between the print head 16 and the platen 14 is varied to adjust or compensate for passage of a record medium such as a passbook 52 (see also FIG. 3).

A detection arm 54 is secured to the left bracket 22 and extends in one direction therefrom and is positioned to be detected by a sensor 56. The sensor 56 is attached to an end 58 of a support arm 60. The support arm 60 is carried on a shaft 62 and such arm 60 supports a lower roller 64 that is opposed to an upper roller 66 carried on a shaft 68. The lower roller 64 is movable and is swingable on the shaft 62 whereas the upper roller 66 is in fixed position relative to the roller 64. The movable roller 64 and the fixed roller 66 are arranged to grip the passbook 52 therebetween as the passbook is conveyed along the feed path in the printer 10. A coil spring 70 is connected to the end 58 of the arm 60 and to a suitable frame portion of the printer 10 to urge the roller 64 against the roller 66 for gripping the passbook 52. The upper roller 66 and the lower roller 64, in effect, operate as a passbook thickness detecting mechanism. The sensor 56 detects upward movement of the platen 14 and the read/write head 36 on the carriage 12.

In order to read data from and to write data on the passbook 52, it is necessary to have the read/write head 36 contact a magnetic stripe on the passbook.

Figure 4:
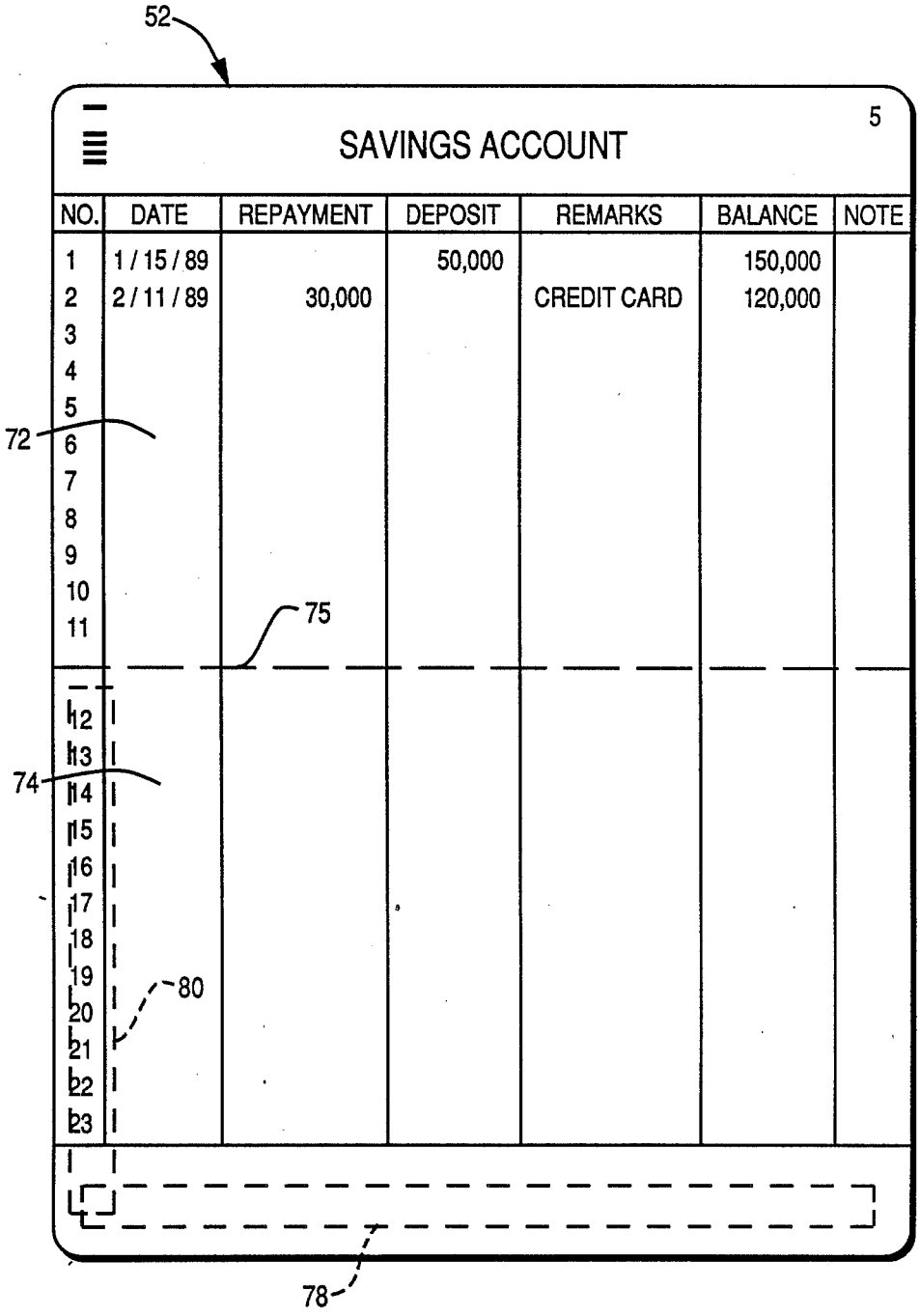
FIG. 4 is a plan view of a passbook in the open condition.

FIG. 4 is a plan view of the passbook 52 in the open condition and showing an upper portion 72 and a lower portion 74 of the passbook with columns provided for printing data or information relative to business transactions. A fold line 75 joins the portions 72 and 74. The column headings may include the line number, date, repayment, deposit, remarks, and balance in the account.

Figure 5:
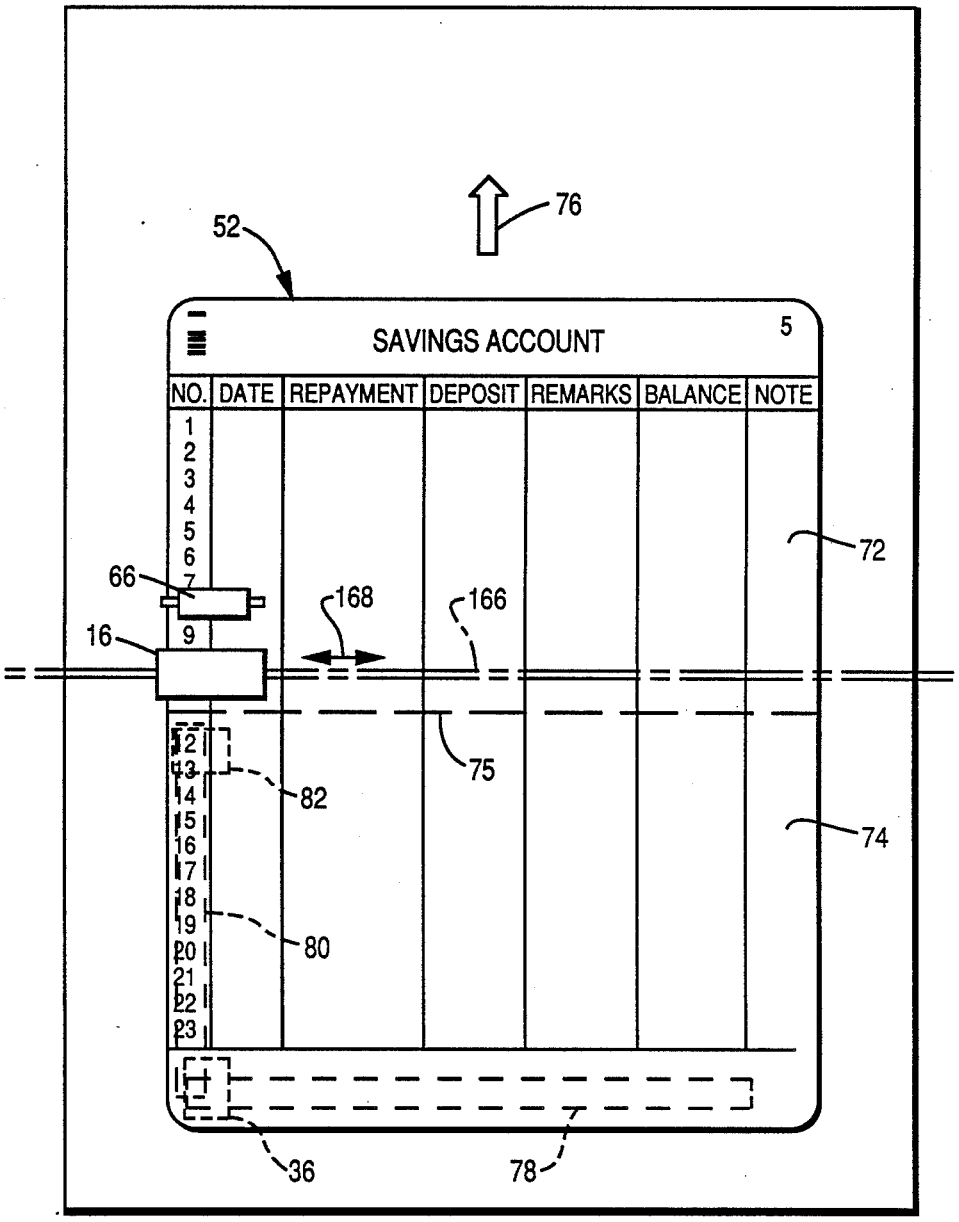
FIG. 5 is a plan view of the passbook and also showing conventional read/write apparatus.

FIG. 5 illustrates the passbook 52 in the open condition and in position for moving through the printer 10 in the direction of the arrow 76. The passbook 52 is moved into position for reading a magnetic stripe 78, oriented in the horizontal or transverse direction, or for reading a magnetic stripe 80, oriented in the vertical or passbook movement direction. The magnetic head 36 is applicable for reading and recording data associated with the magnetic stripe 78 and a magnetic head 82 is applicable for reading and recording data associated with the magnetic stripe 80. In this regard, it is seen that the magnetic head 36 is designed to be movable across the printer for operating with the magnetic stripe 78, whereas the magnetic head 82 is fixed in position at the left side of the passbook 52 for operating with the magnetic stripe 80. In addition to the movement of the carriage 12 and the magnetic head 36 across the printer 10, it is necessary to move the magnetic head in a vertical or up and down direction to accommodate the thickness of the passbook 52.

Figure 2:
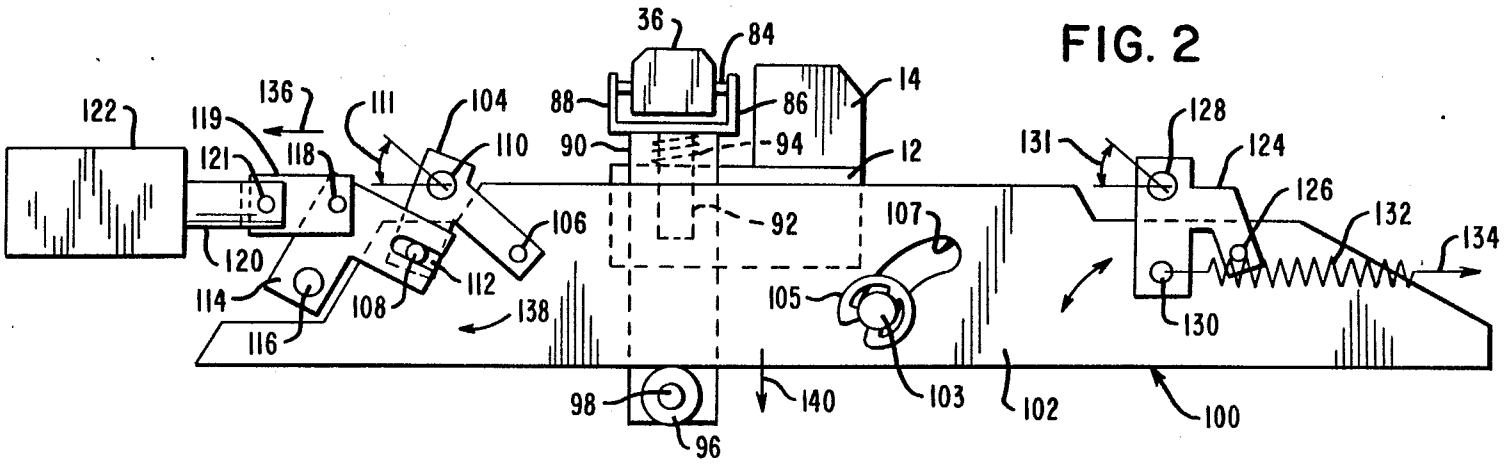
FIG. 2 is an elevational view illustrating height adjusting means for the read/write mechanism.

As seen in FIGS. 1 and 2, the magnetic head 36, which is movable in the up and down direction, is pivoted on a pin 84 coupled to upstanding portions 86 and 88 of a guide member 90 supported on the carriage 12. The guide member 90 is in the form of an angle-type strap and is designed to provide for adjusting the height of the magnetic head 36 in the up and down direction. A downwardly extending support pin 92 is engageable with and supports the guide member 90. The carriage 12 has an opening therein for slidably receiving the support pin 92, and a coil spring 94 is provided between a top surface of the carriage 12 and the bottom surface of the guide member 90 (FIG. 2.) for biasing thereof in the upward direction.

A roller 96 is journaled on a pin 98 secured to the bottom or lower portion of the guide member 90. The roller 96 engages with and rolls along a lower edge 100 of a height adjusting bar 102. An upward force on the guide member 90 is applied by action of the spring 94, while upward movement of such guide member 90 is limited or restricted by the roller 96 engaging with the lower edge 100 of the bar 102. Accordingly, as the height adjusting bar 102 is urged or moved in the downward direction, the guide member 90 is moved down against the action of the spring 94, thus lowering the magnetic head 36. A companion fixed bar 101 is positioned between the downwardly extending portion of the guide member 90 and the height adjusting bar 102. The companion bar 101 is secured at the ends thereof to suitable frame portions of the printer 10. A pin or stud 103 is secured to the bar 101 and extends through a curved slot 107 in the bar 102. A C-clip or the like 105 is placed on the pin 103 to retain the bar 102 on fixed bar 101. The curved slot 107 and the pin 103 operate to guide the bar 102 in the height adjustment of the magnetic head 36.

FIG. 2 is an elevational view of the height adjusting bar 102 and associated parts required for the adjusting operation of the magnetic head 36. The length of the lower edge 100 of the bar 102 is greater than the distance moved by the carriage 12 across the printer 10. The carriage 12 moves in the horizontal direction across the printer 10 while the roller 96 of the guide member 90 engages with the lower edge 100 of the adjusting bar 102 (FIGS. 1 and 2).

An L-shaped arm 104 is pivoted on a pin 106 located and secured at the left side of the bar 102. The L-shaped arm 104 has a pin 108 fixed thereto at the other end of the arm from the pin 106. The central part of the L-shaped arm 104 is pivoted on a pin 110 secured to a suitable frame portion of the printer 10. The pin 108 of the arm 104 engages with a slot 112 which is formed in an adjacent L-shaped arm 114 at one end thereof. The other end of the L-shaped arm 114 is pivoted on a pin 116 which is secured to a suitable frame portion of the printer 10. The central part of the L-shaped arm 114 is pivotally connected by a pin 118 to one end of a link 119. The other end of the link 119 is pivotally connected by a pin 121 to a plunger 120 of a latching solenoid 122 which is secured in suitable manner to the printer 10. The link 119 enables a smooth operation of the plunger 120 relative to the arm 114.

A U-shaped arm 124 is pivoted at one end thereof on a pin 126 located and secured at the right side of the height adjusting bar 102. The central part of the U-shaped arm 124 is pivoted on a pin 128 secured to a suitable frame portion of the printer 10. A pin 130 is attached to the other end of the U-shaped arm 124 from the pin 126 and one end of a spring 132 is connected to the pin 130. The other end of the spring 132 is connected to a suitable frame portion of the printer 10. The spring 132 operates to urge the height adjusting bar 102 toward the right or in the direction of the arrow 134. In the illustration of FIG. 2, the bar 102 is urged toward the right and the magnetic head 36 is in a raised position relative to the print head assembly 16 (FIG. 1).

The structure and arrangement of the L-shaped arm 104 and of the U-shaped arm 124 are designed to provide equal dimensions in certain aspects of the height adjusting mechanism. The distance between the pins 106 and 110 of the L-shaped arm 104 is the same as the distance between the pins 126 and 128 of the U-shaped arm 124. The angle 111 between a line through the pins 106 and 110 and a horizontal line through the pins 110 and 128 is the same as the angle 131 between a line through the pins 126 and 128 and the horizontal line through the pins 110 and 128. The equal dimensions between the pins 106, 110 and pins 126, 128 and the equal angles 111, 131 enable the height adjusting bar 102 to be raised and lowered in a straight, horizontal manner.

When the solenoid 122 is energized, the plunger 120 moves in the direction of the arrow 136 (FIG. 2) and pulls the link 119 to cause the L-shaped arm 114 to be rotated in the counterclockwise direction about the pin 116. In association with such counterclockwise rotation of the arm 114, the pin 108 of the adjacent L-shaped arm 104 engages with the groove 112 to cause the L-shaped arm 104 to be rotated in the clockwise direction about the pin 110. Accordingly, since the L-shaped arm 104 and the height adjusting bar 102 are coupled to each other at one end of the bar 102, the bar is moved in a direction as shown by the curved arrow 138. During such movement of the height adjusting bar 102, the lower edge 100 thereof is maintained on a substantially level plane. As a result of this motion, the height adjusting guide member 90 is lowered by means of the lower edge 100 of the bar 102 being engaged with the roller 96 and which motion causes the spring 94 to be compressed and thereby to lower the magnetic head 36.

When the solenoid 122 is de-energized, the height adjusting bar 102 is moved under the action of the spring 132 in the direction opposite that shown by the curved arrow 138. The bar 102 can be moved in a vertical direction as shown by the arrow 140 under the actions of the L-shaped arms 104 and 114 and of the U-shaped arm 124 while maintaining the lower edge 100 of the bar 102 in a substantially parallel condition. Accordingly, the carriage 12 can be moved in a horizontal direction across the printer 10 while maintaining the height or elevation of the magnetic head 36 at a predetermined value regardless of the position (upper or lower) of the height adjusting bar 102.

Figure 3:
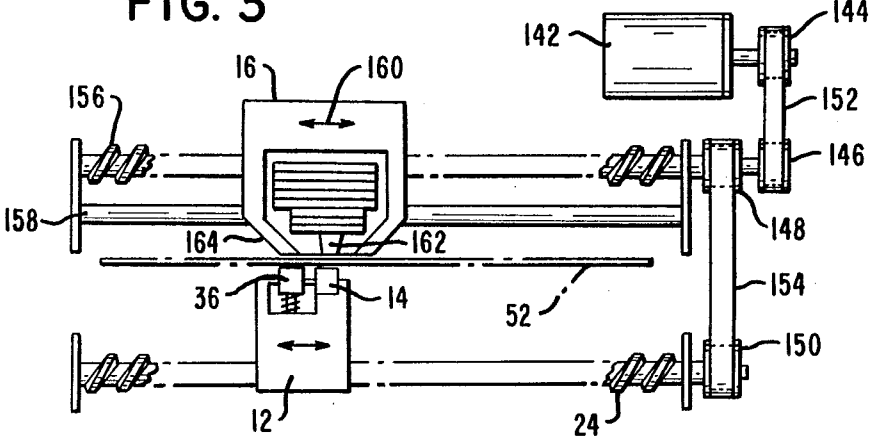
FIG. 3 is an illustration of a drive arrangement for the print head assembly and the read/write mechanism.

FIG. 3 illustrates a drive arrangement for the print head 16 and the carriage 12. The carriage 12 is supported by the lead screw 24 and the guide rod 18 (FIG. 1) for transverse movement on the printer 10. The print head assembly 16 is supported by a lead screw 156 and a guide rod 158 for transverse movement as shown by the double-ended arrow 160. The passbook 52 is shown in position between the print head assembly 16 and the carriage 12 for printing operations and for read/write operations covering the business transaction. A print head element 162 is disposed opposite the platen 14 and the read/write head 36 is disposed adjacent the platen 14. A print head guide 164 is provided for guiding and placing the passbook 52 in position relative to the read/write head 36.

A motor 142 drives a pulley 144 around which is trained a belt 152 for driving a pulley 146 and a pulley 148 on the right end of the lead screw 156. A belt 154 is trained around the pulley 148 for driving a pulley 150 on the right end of the lead screw 24. It is thus seen that the drive arrangement shown in FIG. 3, although different from the arrangement shown in FIG. 1, provides for synchronous movement of the print head assembly 16 and the carriage 12 across the printer 10.

In the operation of the mechanism of the present invention and referring to FIG. 1, the passbook 52 is inserted into position for printing operation and for read and write operations in a business transaction. The carriage 12 with the platen 14 and the magnetic read/write head 36 carried thereon and the print head assembly 16 are at the left side of the printer 10 at the start of the transaction. The carriage 12 is lowered by means of the cams 38 and 40, as described above, so as to facilitate the passing of the passbook 52 between the print head assembly 16 and the magnetic head 36, as shown in FIG. 3. The print head guide 164 along with the platen 14 and the magnetic head 36 act as upper and lower guide means for the passbook 52 as it is being conveyed or transported past the printing station.

The passbook 52 is received and gripped by the rollers 64 and 66 (FIG. 1) and the thickness of the passbook is detected. The cams 38 and 40 on the shaft 42 are rotated by the motor 50 through the gears 44 and 46 which action raises the brackets 20 and 22 and the carriage 12. When the detection arm 54 on the bracket 22 is detected by the sensor 56, the motor 50 stops and the thickness of the passbook 52 is determined by operation of the several individual elements. A predetermined count of the number of steps required of the stepping motor 50, under conditions when a passbook 52 is not present between the print head assembly 16 and the platen 14, is stored in memory. In this regard, the position of the detection arm 54 is associated with the predetermined count of the required steps when a passbook 52 is not present. The predetermined count of the steps is then compared with the actual number of steps of the stepping motor 50 when the passbook 52 is present to determine the thickness of the passbook. When the passbook 52 is gripped between the rollers 64 and 66, the roller 64 is lowered by an amount corresponding to the thickness of the passbook 52 and the sensor 56 is lowered by an equal amount subject to the difference in distances of the roller 64 and the sensor 56 from the pivot shaft 62. Therefore, the detection arm 54 is detected in a position which is lower by an amount which corresponds to the thickness of the passbook 52 and the amount that the carriage 12 is raised. In this regard, it is noted that the number of steps taken by the stepping motor 50 is smaller when a passbook 52 is present and is gripped by the rollers 64 and 66 when compared with the number of steps taken by the motor 50 when no passbook is present. The thickness of the passbook 52 is determined from the relative positions of the individual elements wherein the gap between the print head element 162 of the print head assembly 16 and the platen 14 can be adjusted to an optimum value for printing operation. As an alternative, the detecting arm 54 and the sensor 56 can be calibrated to provide for suitable gaps for a number of printing operations dependent upon the thickness of the passbook 52 at the printing station.

After the gap between the print head element 162 and the platen 14 has been adjusted by positioning the carriage 12, the printing operation is performed. The printing operation is performed under the control of a control unit (not shown). During the printing operation, the print head assembly 16 and the platen 14 are positioned in opposed relationship so that the print head assembly 16 and the carriage 12 are driven in synchronous manner. In this regard, the print head assembly 16 and the carriage 12 may be driven with separate drive means or the print head assembly 16 and the carriage 12 may be driven from the same motor, as 142 in FIG. 3.

In a magnetic reading/writing operation, the passbook 52 is conveyed or transported in a manner and to a position wherein the magnetic stripe 78 (FIG. 5) is located directly above the magnetic head 36. The magnetic head 36 is located at the left side of the print station and the height or elevation of the carriage 12 with the magnetic head 36 and the platen 14 is adjusted and maintained at the value required for the correct printing gap. In the reading/writing operation, it is necessary to move the magnetic head 36 into position to contact the magnetic stripe 78. In this regard, the head 36 should be raised to a position higher for a read/write operation than the position of the print head in a printing operation. In such read/write position, the magnetic head 36 is brought into contact with the magnetic stripe 78. The magnetic head 36 and the platen 14 are raised by means of the height adjusting mechanism shown in FIG. 2. When the magnetic head 36 is raised, the passbook 52 is gripped by the rollers 64 and 66 and is confined between the print head assembly 16 and the magnetic head 36 so that the magnetic head 36 comes into contact with the magnetic stripe 78. It is noted that pressing of the passbook 52 by the print head assembly 16 on the side opposite that of contact of the magnetic head 36 with the magnetic stripe 78 and using the read/write apparatus in read/write operation, the carriage 12 and the print head assembly 16 move in synchronous manner as in printing operation (FIG. 3).

Referring again to FIGS. 4 and 5, a passbook 52 in the open condition is shown passing the printing station, as indicated by the double line 166 in FIG. 5. As mentioned above, the passbook 52 includes the pages for the printed data or information and includes the magnetic stripes 78 and 80 on the back cover of the passbook. The print head assembly 16 moves in the direction of the arrow 168 and prints data in the lines of the passbook 52. Reading/writing or recording operations of data are magnetically performed by the magnetic head 36 which moves with the carriage 12 and operates with the magnetic stripe 78. The magnetic head 82 is fixed in position relative to any transverse movement and operates with the magnetic stripe 80. In the case of the two magnetic heads 36 and 82 (FIG. 5), it is seen that separate drive mechanisms would be required to drive the two magnetic heads in read/write operations of the magnetic stripes on the passbook 52.

The present invention provides a carriage 12 that carries the platen 14 and the magnetic head 36 as a unit across the printer, so that a separate carriage or conveying mechanism is not required for the magnetic head 36. The magnetic head 36 moves across the printer 10 and reads data from the horizontal magnetic stripe 78 in a carriage traversing operation. The magnetic head 36 may also be designed and constructed to read data from a vertical magnetic stripe 80 wherein the magnetic head 36 may be oriented relative to the stripe 80 so that the head 36 can be stopped in a predetermined position to read the stripe 80. There is no need to change the reading and writing mechanism in order to accommodate different kinds of passbooks and different arrangements of magnetic stripes. The providing of the magnetic head 36 on the carriage 12 and along the print line 166 enables miniaturization of the overall apparatus.

It is thus seen that herein shown and described is a passbook read/write mechanism having a carriage 12 that carries both the printing platen 14 and the magnetic read/write head 36 across the printer 10 and which mechanism includes an adjusting member 102 for changing the height of the read/write head 36.

The structure and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A passbook printer for use with a passbook, said printer comprising a carriage, a print head and means for moving the print head across the printer, a platen operating at a printing station with said print head and carried by said carriage, means for driving said carriage across said printer in a direction normal to the path of the passbook past the printing station, and a magnetic head carried by said carriage and positioned to operate with a magnetic stripe on said passbook, said printer including means for moving the print head and the magnetic head relative to each other and said printer including means for moving said heads in synchronism across said printer to print data on said passbook and to read data from and to write data into said magnetic stripe on said passbook.

2. The passbook printer of claim 1 including means associated with said carriage and with said magnetic head for sensing the thickness of said passbook.

3. The passbook printer of claim 1 including means for changing the height of said magnetic head relative to said print head.

4. The passbook printer of claim 1 wherein said magnetic head is positioned adjacent said platen on said carriage.

5. The passbook printer of claim 1 wherein said magnetic head is supported on an adjusting member adjacent said platen and coupled to said carriage.

6. The passbook printer of claim 2 wherein said sensing means comprises a swingable member on the printer and an arm secured to the swingable member and a sensor operably associated with said arm to detect movement of the arm relative to thickness of the passbook.

7. The passbook printer of claim 5 wherein said magnetic head is pivotally supported on said adjusting member.

8. The passbook printer of claim 3 wherein said height changing means comprises a member supporting said magnetic head and a plate member operably associated with said supporting member and movable to change the height of said magnetic head relative to the print head.

9. The passbook printer of claim 8 wherein said supporting member includes a roller thereon which engages an edge of said plate member for limiting movement of said supporting member and said magnetic head in a vertical direction.

10. In a passbook printer for use with a passbook, said printer having a print head, means for moving the print head across the printer, a carriage for carrying a platen, and means for moving the carriage across the printer, the improvement comprising a magnetic head carried on said carriage adjacent said platen and positioned to operate with a magnetic stripe on said passbook, said printer including means for moving the print head and the magnetic head relative to each other and said printer including means for moving said heads in synchronous manner across said printer to print data on said passbook and to read data from and to write data into said magnetic stripe.

11. In the passbook printer of claim 10 including means operably associated with said magnetic head for sensing the thickness of said passbook.

12. In the passbook printer of claim 10 including means for changing the height of said magnetic head relative to said print head.

13. In the passbook printer of claim 10 including an adjusting member coupled to said carriage for supporting said magnetic head adjacent said platen.

14. In the passbook printer of claim 11 wherein said means for sensing includes a swingable member on the printer and an arm secured to the swingable member and a sensor operably associated with said arm to detect movement of the arm relative to thickness of the passbook.

15. In the passbook printer of claim 12 wherein said height changing means comprises a support member for said magnetic head and a plate member operably associated with said support member and movable to change the height of said magnetic head relative to said print head.

16. In the passbook printer of claim 10 including camming means operably associated with said carriage for moving thereof dependent upon the thickness of said passbook.

* * * * *